US007722316B2

(12) United States Patent
Scarinci et al.

(10) Patent No.: US 7,722,316 B2
(45) Date of Patent: May 25, 2010

(54) ACOUSTIC VISCOUS DAMPER FOR CENTRIFUGAL GAS COMPRESSOR

(75) Inventors: Thomas Scarinci, Mont-Royal (CA); Mohammed Jalal Uddin, Mount Vernon, OH (US); Robert Meier, Mount Vernon, OH (US)

(73) Assignee: Rolls-Royce Power Engineering PLC, Derby (GB)

( * ) Notice: Subject to any disclaimer, the term of this patent is extended or adjusted under 35 U.S.C. 154(b) by 701 days.

(21) Appl. No.: 11/520,069

(22) Filed: Sep. 13, 2006

(65) Prior Publication Data

US 2010/0034634 A1 Feb. 11, 2010

Related U.S. Application Data

(60) Provisional application No. 60/717,116, filed on Sep. 13, 2005.

(51) Int. Cl.
*F04D 29/44* (2006.01)

(52) U.S. Cl. ..... 415/119; 415/206; 415/224.5

(58) Field of Classification Search ..... 415/52.1, 415/58.6, 119, 224.5, 211.2, 914, 56.4, 58.2
See application file for complete search history.

(56) References Cited

U.S. PATENT DOCUMENTS

| | | | | |
|---|---|---|---|---|
| 2,399,072 | A * | 4/1946 | Thompson | 415/52.1 |
| 3,362,629 | A * | 1/1968 | Papapanu | 415/58.4 |
| 3,460,748 | A * | 8/1969 | Erwin | 415/98 |
| 3,749,520 | A * | 7/1973 | Bandukwalla | 416/183 |
| 3,957,392 | A | 5/1976 | Blackburn | |
| 3,991,849 | A | 11/1976 | Green et al. | |
| 4,421,455 | A | 12/1983 | Tomren | |
| 4,969,536 | A | 11/1990 | Allen | |
| 5,173,020 | A | 12/1992 | Ebbing et al. | |
| 6,601,672 | B2 * | 8/2003 | Liu | 181/290 |
| 6,669,436 | B2 | 12/2003 | Liu | |
| 6,802,690 | B2 | 10/2004 | Han et al. | |
| 6,881,029 | B2 | 4/2005 | Le Biez et al. | |
| 2002/0015640 | A1 | 2/2002 | Nishiyama et al. | |
| 2002/0064453 | A1 | 5/2002 | Tse | |
| 2004/0005215 | A1 | 1/2004 | Della Mora | |
| 2006/0245913 | A1 * | 11/2006 | Thiele et al. | 415/116 |

FOREIGN PATENT DOCUMENTS

| | | | |
|---|---|---|---|
| JP | 54133613 | A * | 10/1979 |
| WO | WO 2005028876 | A1 * | 3/2005 |

OTHER PUBLICATIONS

JP 54133613 A Translation. The McElroy Translation Company. Mar. 2009.*

Eldredge, J.D. and Dowling, A.P., "The absorption of axial acoustic waves by a perforated liner with bias flow", Journal of Fluid Mechanics, vol. 485, pp. 307-335 (2003).

* cited by examiner

*Primary Examiner*—Richard Edgar
(74) *Attorney, Agent, or Firm*—Krieg DeVault LLP; Matthew D. Fair, Esq.

(57) ABSTRACT

An acoustic viscous damper for a compressor including a porous liner located within the discharge duct, the porous liner having a plurality of holes for passage of a purge working fluid therethrough into the discharge duct.

20 Claims, 4 Drawing Sheets

ACOUSTIC VISCOUS DAMPER FOR CENTRIFUGAL GAS COMPRESSOR

CROSS-REFERENCE TO RELATED APPLICATIONS

The present application claims the benefit of U.S. Provisional Patent Application No. 60/717,116 filed Sep. 13, 2005 and entitled Acoustic Viscous Damper For Centrifugal Gas Compressor, which is incorporated herein by reference.

BACKGROUND

The present invention relates generally to compressors and more particularly, but not exclusively, to centrifugal gas compressors.

Centrifugal gas compressors are known to have problems with noise believed to originate from the airfoils of the impellers. Many such compressors will have at least one rotating radial impeller mounted within a rigid casing and will further include an inlet pipe and inlet plenum and discharge pipe and a discharge plenum. The rapid rotation of the blades of the impeller causes them to set up some harmful pressure pulsations inside the working fluid. These pulsations can be transmitted through the discharge pipe, or other components of the compressor, resulting in potential mechanical damage or environmental noise.

It is believed that the space-varying pressure field surrounding each of the airfoils of the impeller is acting as a source of noise. This noise is due to the rapid rotation of the airfoils inside the pressurized casing of a typical gas compressor. The pressure field of each airfoil may interact with other components, such as diffuser vanes. Similarly, the pressure field of each airfoil may interact with the geometry of the collector plenum itself. In both such scenarios, pressure pulsations are developing inside the collector plenum at approximately the so-called blade passing frequency. The blade passing frequency is approximately equal to rotation speed of the impeller in rotations per second times the number of impeller blades. These pulsations are potentially of a high enough level to cause mechanical or environmental concerns. Consequently, significant efforts have focused on developing mechanisms to minimize pressure pulsations within compressors.

Heretofore, there has been a need for compressors having improved noise characteristics when considered in view of other characteristics such as unit cost, ease of design, and other competing tensions.

SUMMARY

One embodiment according to the present invention is a porous liner within a discharge duct of a centrifugal compressor. Other embodiments include unique apparatuses, systems, devices, hardware, methods, and combinations of these for use with any gas compressor where pressure pulsations may be a problem. Further embodiments, forms, objects, features, advantages, aspects, and benefits of the present invention shall become apparent from the following description and drawings.

DESCRIPTION OF THE ILLUSTRATIVE EMBODIMENTS

Figure 1:
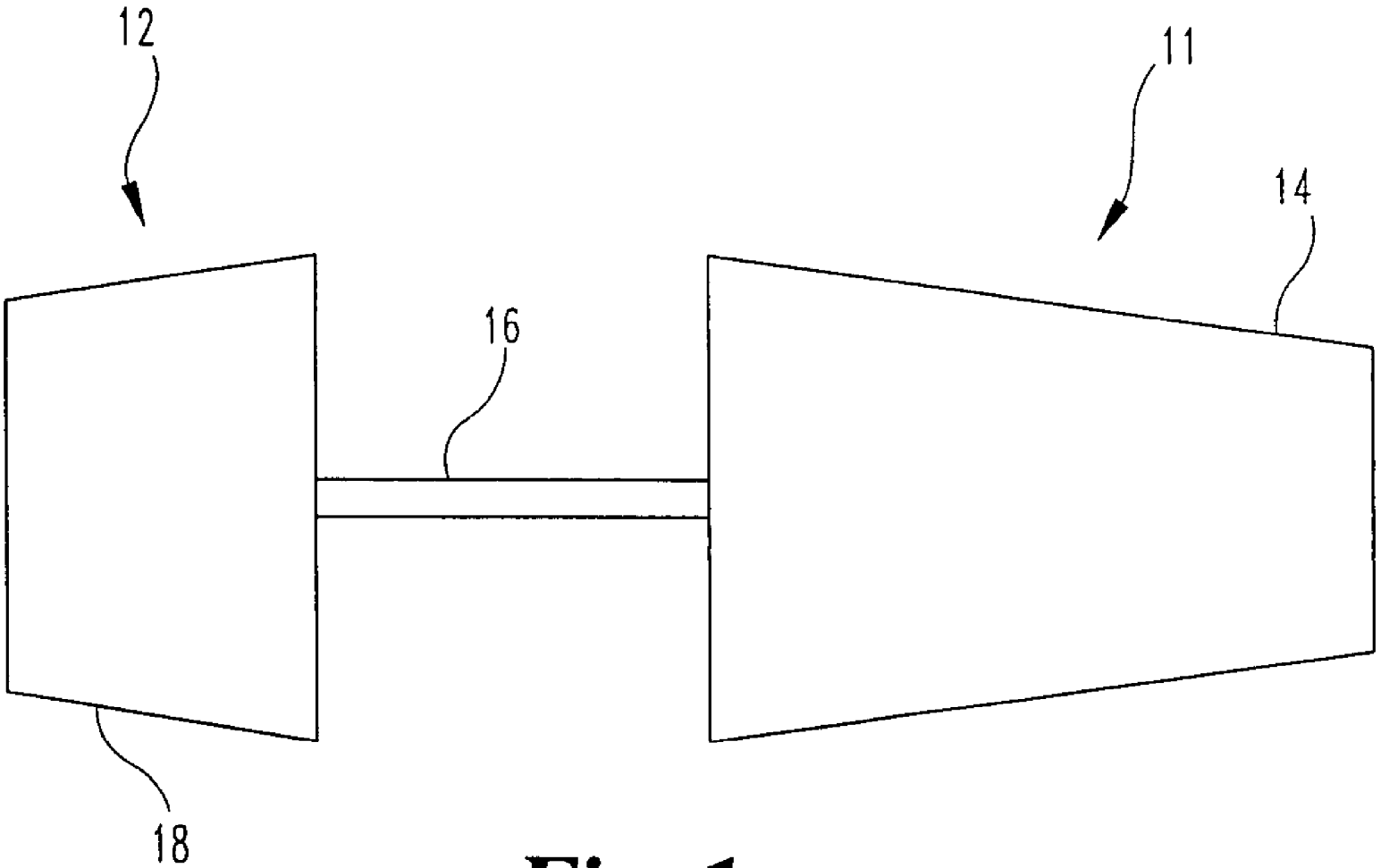
FIG. 1 is an illustrative view of an illustrative machine including a compressor and a drive unit.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a schematic representation of a machine 11. This non limiting depiction of machine 11 includes a compressor 12, a drive unit 14 and a drive mechanism 16 coupling drive unit 14 to compressor 12 in order to drive compressor 12. Compressor 12 includes a housing or casing 18. In one illustrative embodiment, machine 11 is a land based gas turbine engine. In other illustrative embodiments, compressor 12 is a stand alone compressor unit and drive unit 14 is an external power source. In some illustrative embodiments, multiple compressors 12 may be utilized. Industrial power plant applications include, for example, pumping sets for gas and oil transmission lines and electricity generation systems. General details regarding gas turbines will be omitted as it is believed a person of skill in the art will be familiar with gas turbine technology and associated components.

As previously noted, the present invention relates generally to compressors. Such compressors include, but are not limited to, centrifugal gas compressors typically used in pumping stations of natural gas pipelines. Although, various details of the present invention are discussed below with reference to use in a centrifugal gas compressor, other applications may exist. For example, it will be understood by those of ordinary skill in the art that the present invention might be applied to any centrifugal gas compressor where pressure pulsations might be a problem. Centrifugal gas compressors in which an embodiment of the acoustic viscous damper of the present invention might be applied typically include an inlet pipe, an inlet plenum, an impeller having at least one blade, an annular discharge duct, a discharge plenum or compressor, and a discharge pipe. The impeller may or may not have a so-called inducer. The annular discharge duct may or may not have a set of radial diffuser vanes.

In one embodiment of the present invention, the discharge duct downstream of the impeller blades is equipped with a single-layer or a multi-layer porous liner including, but not limited to, a porous sheet made of metal or other materials having a suitable porosity including, but not limited to, carbon steels, stainless steels, ceramic composite meshes. A small purge flow of working fluid flows through the porous liner, preferably fed via the natural-occurring pressure difference across the casing wall of the discharge duct. Viscous dissipation of acoustic energy is believed to result from the porosity of the liner, and the interaction between the purge flow and the pressure pulsations. Such viscous dissipation thereby reducing the amplitude of pressure pulsations over a preferably wide range of frequencies. The range of frequencies is typically wider in various embodiments of the present invention than exists in Helmholtz resonators, but the peak in attenuation is typically less, i.e. Helmholtz resonators give one narrow sharp peak of high damping—viscous gives a wider range of frequencies but lower amplitude of attenuation.

Figure 2:
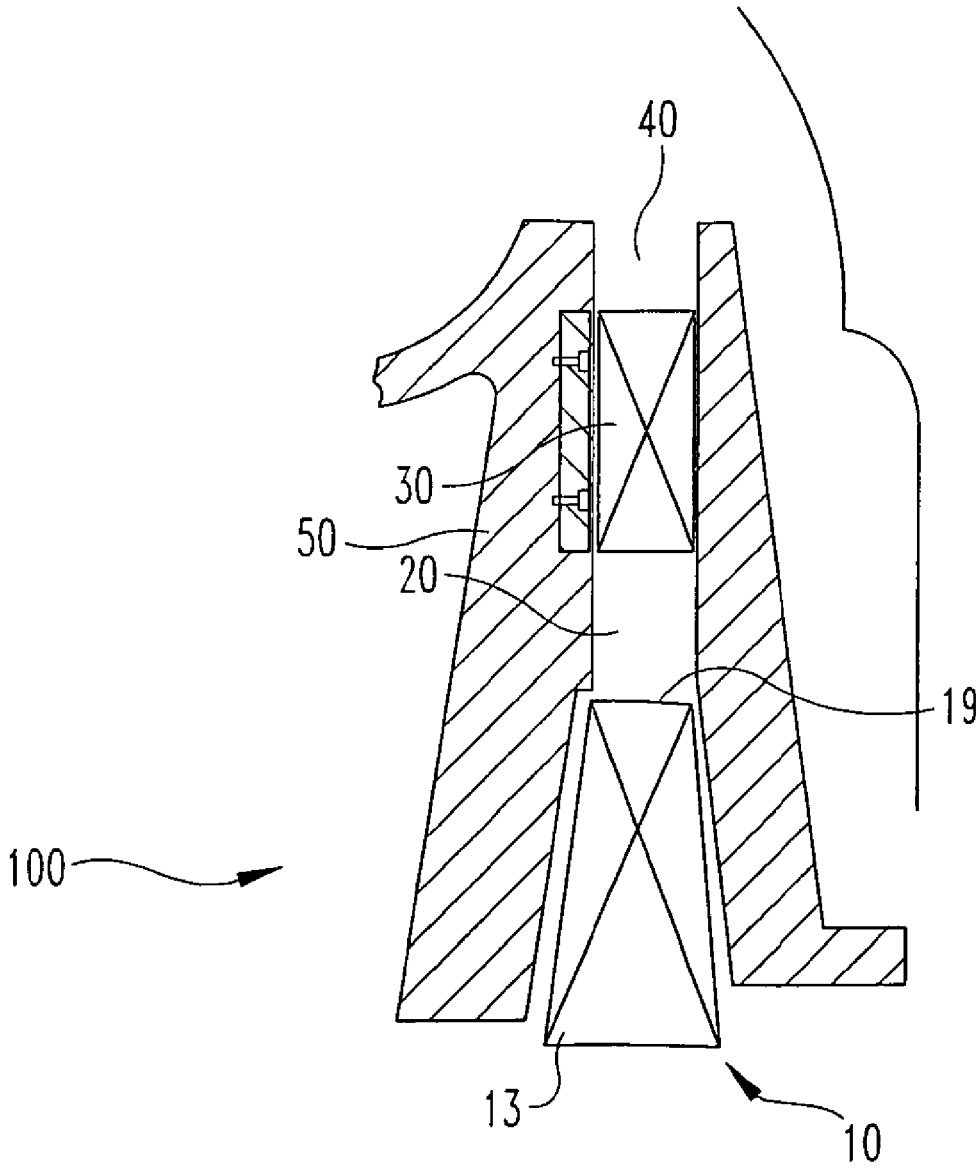
FIG. 2 is a partial cross-sectional view of a portion of a centrifugal gas compressor according to an embodiment of the present invention.
Figure 3:
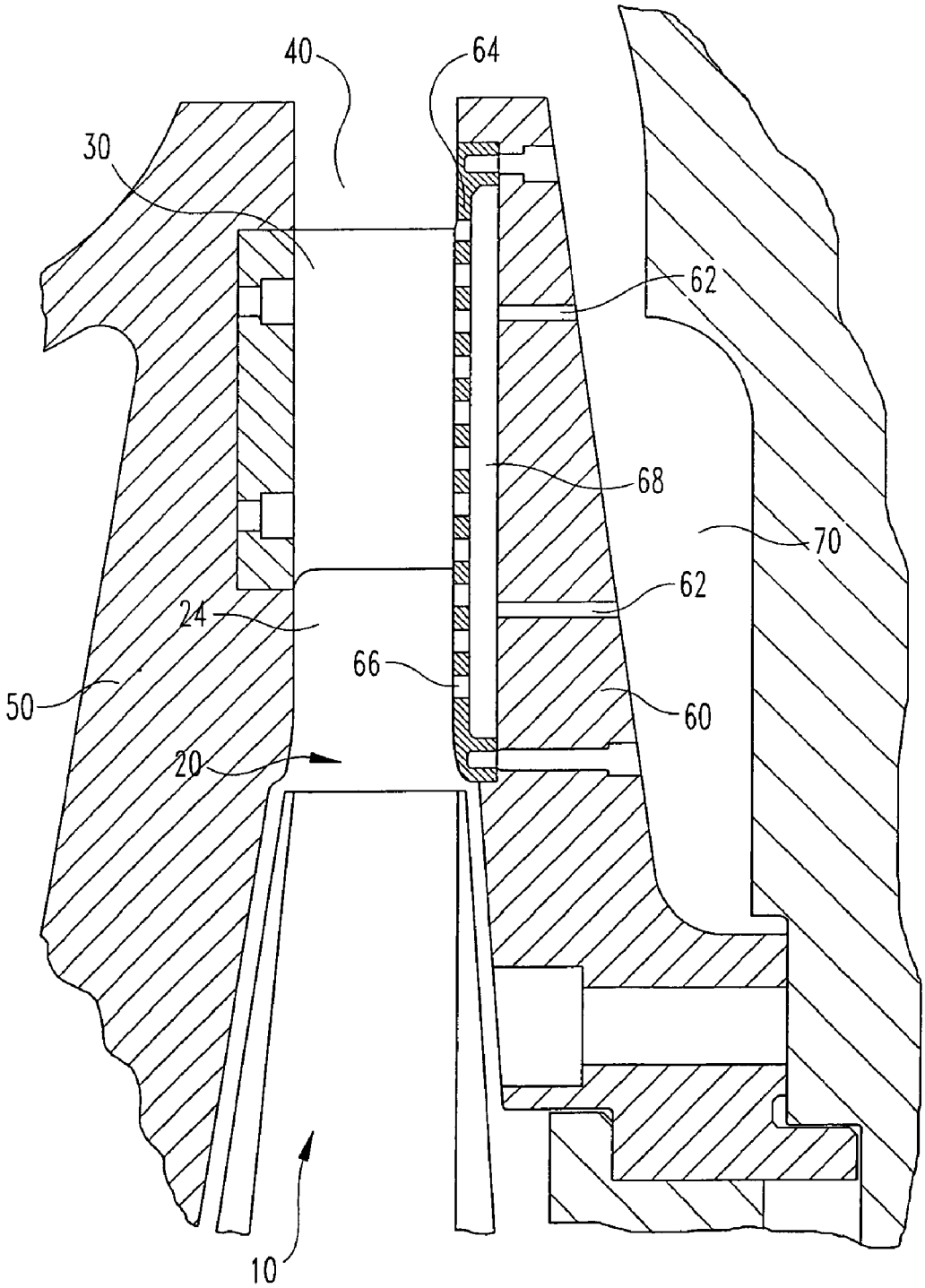
FIG. 3 is an enlarged partial cross-section view of the compressor of FIG. 2.

With reference to FIGS. 2 and 3, there is illustrated a partial cross-sectional view of a portion of a compressor 100. FIG. 2 illustrates generally aspects of an embodiment of the present invention. FIG. 3 is an enlarged view of a portion of the annular discharge duct of FIG. 2 and illustrates additional details.

It is contemplated as within the scope of the present invention that the present invention may be used in a great variety of compressor designs and geometries. With reference to FIG. 2, compressor 100 has a housing or casing (not illustrated) similar to the housing 18. Compressor 100 includes a rotatable impeller 10 having at least one blade 13. The trailing edge 19 of blade 13 is substantially adjacent to the entry 20 of annular discharge passage 24. Annular discharge duct 24 extends between entry 20 and outlet 40. A plurality of outlet guide vanes 30 may or may not be present in the portion of discharge duct 24 that is preferably at or near outlet 40.

Figure 3A:
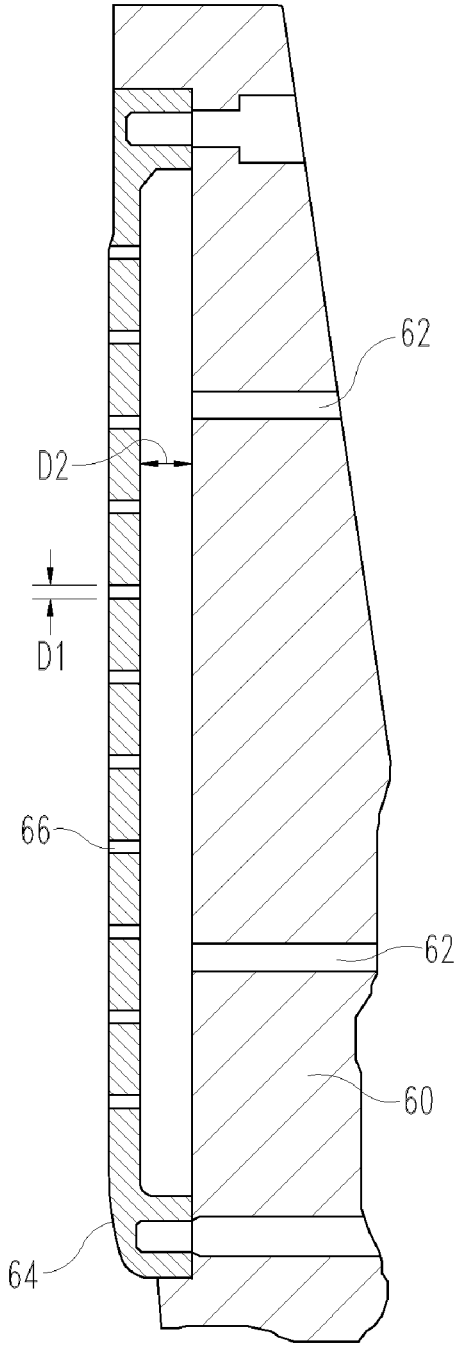
FIG. 3A is an enlarged partial cross-section of a liner in accordance with an embodiment of the present invention.
Figure 3B:
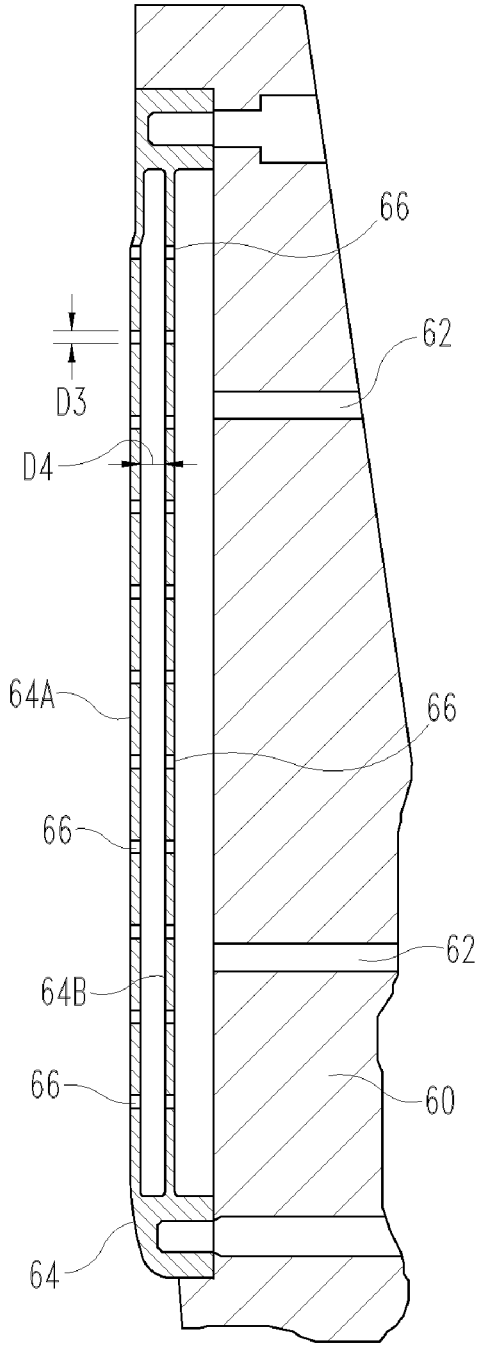
FIG. 3B is an enlarged partial cross-section of a liner in accordance with another embodiment of the present invention.

With reference to FIG. 3, the annular discharge duct 24 is bounded by a front discharge wall 50 and a back-side discharge wall 60. In the illustrated embodiment, at least a portion of the back-side discharge wall 60 includes the viscous dissipation liner 64 that defines a plurality of openings 66. Air damping holes 66 of porous liner 64 extend between discharge duct 24 to a middle air feed cavity 68. Middle air feed cavity 68 receives purge working fluid via air inlet metering holes 62. Air inlet metering holes 62 extend through back-side discharge wall 60 and are in turn fed by back-side upstream air feed plenum 70. Middle air feed cavity 68 is primarily defined by the spacing between the porous liner 64 and the back-side discharge wall 60. In various embodiments of the present invention, e.g., see FIG. 3A, this spacing D2 is preferably chosen to be no less than 3 to 4 times the diameter D1 of the air damping holes 66. Similarly, in two-layer arrangements, e.g., see FIG. 3B, the spacing D4 between the layers 64A and 64B of porous metal sheets is preferably chosen to be no less than 3 to 4 times the diameter D3 of the air damping holes 66. In one preferred embodiment the separation distance is not substantially greater than the average spacing between metal sheet perforations.

The porous portion of the liner 64 preferably extends from the trailing edge 19 of the blade 13 of rotatable impeller 10 as far as possible along the gas-washed surface (or surfaces) of the wall(s) of discharge duct 24. The porous portion of liner 64 even more preferably extends all the way to the end of the discharge duct 24 (just before the dump into the collector plenum 70). To the extent that diffuser vanes 30 are present, in one embodiment of the present invention it is preferred that the liner 64 also extends over the diffuser vanes 30. That is to say, it is contemplated as within the scope of the invention that a portion of the outer surface of one or more of diffuser vanes 30 might also include the porous liner disclosed herein.

The blade or blades 13 of rotatable impeller 10 impart velocity to a working fluid and force the working fluid into entry 20 of discharge duct 24. To the extent that outlet guide vanes 30 are present, the vanes 30 direct the working fluid into and/or through the outlet 40 of discharge duct 24. Working fluid flows through the outlet 40 of the discharge duct 24 into, for example, a discharge scroll (not illustrated) that collects the higher pressure working fluid. As illustrated, the working fluid flows into a back-side air feed plenum 70.

Prior to further discussion of the drawings and/or other details concerning the present invention, it is helpful to first review prior art acoustic treatment of centrifugal gas compressors such as those disclosed in U.S. Pat. No. 6,669,436 to Zheji Liu entitled "Gas Compression Apparatus And Method With Noise Attenuation" and U.S. Pat. No. 6,601,672 to Zheji Liu entitled "Double Layer Acoustic Liner And A Fluid Pressurizing Device And Method Utilizing The Same." U.S. Pat. No. 6,669,436 uses arrays of Helmholtz resonators. U.S. Pat. No. 6,601,672 shows multiple resonator arrays at various locations around a centrifugal gas compressor. This prior art relies on distinct and isolated Helmholtz resonating cavities. Acoustic damping frequency in such cavities is determined by the Helmholtz formula:

$$\omega=(k/m)^{1/2}=c*(A/V*L)^{1/2} \quad (1)$$

i.e. the damping frequency is a function of the resonating volume and the dimensions of the so-called "neck". Formula (1) above is essentially the design rule by which the embodiments disclosed in the two above referenced patents are designed. The Helmholtz cavities in this prior art are closed cavities—there is no net flow through the apertures formed by the "necks." Consequently, the closed volumes act as a compressible volume, that serve as a "spring" that oscillates the mass of gas found in the "neck" of the resonator.

At least one of the two above referenced prior art patents also appears to refer to the use of so-called quarter-wave tubes as a mechanism to achieve acoustic absorption. The damping frequency of a quarter-wave tube is given by the classical formula:

$$f=c/(4*L)=\omega/(2*\pi) \quad (2)$$

Quarter-wave tubes are also closed cavities, with no throughput through any aperture that is used to attenuate the sound.

Returning now to the description of various embodiments of the present invention, with reference to FIG. 3 it will be understood that in one embodiment of the present invention the discharge duct 24 includes a liner 64. In one preferred embodiment, liner 64 comprises one or more porous metal sheets. It should be understood that within the present disclosure, porous liner 64 is often interchangeably referred to as a porous metal sheet or sheets. In another preferred embodiment, the porous liner 64 comprises a two-layer arrangement (it being understood that a two layer configuration provides better acoustic attenuation levels but increases unit cost). When a two layer configuration is used, however, the porosity of the second layer is preferably comparable to that of the first layer.

In the embodiment illustrated in FIG. 3 the porous liner 64 is on a portion of the back-side discharge wall 60. In one preferred embodiment the porous liner 64 comprises one or two porous layers on at least one wall (50 or 60) of the annular discharge duct 24. It should be understood that it is contemplated as within the scope of the invention that the liner 64 may instead be on a portion of the front discharge wall 50, or on some combination of a portion of the front discharge wall 50 and a portion of the back-side discharge wall 60. It should also be understood that it is contemplated as within the scope of the invention that the portion of either of walls 50 and 60 might include the entirety of both walls, or a portion of one wall and the entirety of the other wall.

For purposes of the present application, porosity is defined as the area of holes (or perforations) per unit area of the fluid-exposed sheet(s) (preferably made of metal). In one preferred embodiment, the porosity of the metal sheet layer or layers is preferably selected to be sufficiently large so as maximize the amount of viscous damping over a range of frequencies. It will be understood by those of ordinary skill in the art, however, that the porosity is also preferably sufficiently small so as to satisfy the mechanical integrity requirements of the preferably annular discharge duct 24. In the most preferred embodiment of the present invention the porosity of the liner 64 is in the range of about 3% to about 10%. The porosity of liner 64 is preferably achieved by a large number of small diameter holes, rather than a smaller number of large diameter holes. Diameters of the holes are preferably in the range of about 1 mm to about 5 mm.

In the above described embodiments of the present invention the porous liner 64 (along one or both of fluid-washed surfaces of front discharge wall 50 and/or back-side discharge wall 60) in discharge duct 24 is fed by a small flow of working fluid so as to preferably optimize the damping performance (within limitations that trade off such things as acoustic attenuation levels and unit cost). That is to say, various embodiments of the present invention use a small purge flow of working fluid flowing through the porous layer(s) of acoustic liner 64. In one embodiment of the present invention this small purge flow of working fluid is driven by a positive pressure difference that exists between the collector plenum 70 and the pressure inside the discharge duct 24 into which the purge flow is diffusing. A small number of purge feed holes 62 are drilled through the back-side discharge wall 60. The size and number of purge feed holes 62 is selected so as to (a) provide the appropriate Mach numbers across the perforations 66 of liner 64; and, (b) to provide a more uniform distribution of purge flow around the perimeter of the discharge duct 24.

The purge flow Mach number [$Mach_{purge\ flow}$] is defined as: purge mass flow (kg/sec) [$m_{purge}$] divided by the product of the working fluid density (kg/m$^3$) [$\rho_{working\ fluid}$] times the porosity of the metal sheet times the surface area of the porous metal sheet (m$^2$) [$A_{liner}$], divided by the average sound speed of the working fluid [$c_{working\ fluid}$]. Thus, formula (3) below applies:

$$Mach_{purge\ flow} = \frac{m_{purge}}{\rho_{working\ fluid} * \text{porosity} * A_{liner} / c_{working\ fluid}} \tag{3}$$

Preferably, the purge flow Mach number [$Mach_{purge\ flow}$] is chosen to be greater than zero, but less than 0.05. Furthermore, in various embodiments of the present invention the purge flow Mach number is chosen so as to maximize the amount of acoustic absorption from the arrangement of the present invention.

In contrast to the two prior art patents mentioned above, the present invention does not obey the classical relationships given either by formula (1) or formula (2) above. Formulas (1) and (2) are not necessary as a design rule to implement various embodiments of the present invention. Instead, as will be understood by those of ordinary skill in the art, the relevant design parameters for embodiments of the present invention will usually include one or more of the following: (a) the porosity of the liner 64; (b) the size of the holes 66; and, (c) the flow rate through the holes 66. It should be understood that the velocity through the air damping holes 66 can be expressed as a Mach number through the holes.

The mechanism of acoustic damping is not of a reactive type like the prior art, but instead makes use of viscous dissipation. It will be understood that the claims of the present invention are not limited by the description of the inventors' understanding of the physics of the phenomenon of viscous dissipation. It is believed in this instance that the viscous dissipation results from the creation of a vortical flow from the acoustic oscillations induced at a discharge jet through the hole. It is found that for a given geometry of the discharge hole and frequency of sound, there is an optimal Mach number of the air across the hole that maximizes the acoustic absorption by this mechanism. Since this mechanism of acoustic damping appears to rely on the creation of vortex structures, it has been found that the dimensions of the resonating cavity are of minimal effect on this mechanism. This is in sharp contrast with the prior art Helmholtz cavities wherein the dimensions of the resonating cavity are of critical importance. Instead, in embodiments of the present invention the middle air feed cavity 68 is preferably designed from a consideration of ensuring a uniform supply of air, as opposed to providing a resonating or oscillating volume.

Thus, embodiments of the present invention preferably provide a very wide range of acoustic absorption, and also preferably provide more compactness of the apparatus providing acoustic attenuation. It should be understood that the scope of the present invention is defined by the claims, and is not limited to various advantageous results discussed herein unless such results are specifically claimed. Having noted such, the features relating to acoustic absorption and compactness are typically obtainable since various embodiments of the present invention rely on the above discussed use of "viscous damping" of acoustic waves, as opposed to the use of Helmholtz resonators. Helmholtz resonators need to be 'tuned' to a specific and narrower frequency band. The principles of some of the underlying physical phenomena are disclosed in publications such as the article by Eldredge, J. D. and Dowling, A. P. entitled "The absorption of axial acoustic waves by a perforated liner with bias flow," *Journal of Fluid Mechanics* (2003), Vol. 485, pp. 307-335.

Acoustic absorption of a wider range of frequencies results in a number of potential benefits such as:

a) Harmful pressure pulsations are controlled over a large range of machine speeds, and so embodiments of the invention are effective at part load as well as at full load.

b) Tolerance to variations in physical dimensions (including, but not limited to, manufacturing tolerances) since various embodiments of the invention do not need to be precisely 'tuned' at a specific frequency.

c) A large number of possible acoustic modes can be covered.

d) A given geometry and arrangement (porosity of the metal layer, number of layers, spacing between layers, amount of purge flow) can be more readily applied to a large number of fluid (particularly gas) compressor variants, avoiding the need of a re-design for each new application.

The compactness of various embodiments of the present invention over that disclosed in prior art, such as the above discussed patents to Liu, stems largely from the small thickness of the porous metal sheets and the small spacing between the metal sheets The thickness of the metal sheets does have an impact, it being understood that thinner is preferably better. The thickness of the present invention is determined by the mechanical strength requirements of the perforated wall, rather than from acoustic considerations. This is markedly different from the above discussed patents to Liu. Improved compactness makes it relatively more easy to apply to a larger number of different fluid compressor designs. Improved compactness is also preferred from a unit cost perspective.

The present invention provides an improved mechanism for reducing and/or eliminating pressure pulsations in centrifugal gas compressors.

One form of the present invention contemplates a centrifugal gas compressor, comprising: a housing; a rotatable impeller including a plurality of blades located within the housing and adapted for performing work on a working fluid; an annular discharge duct in fluid communication with the rotatable impeller, the annular discharge including at least one surface; and a porous liner located within the annular duct and extending along the at least one surface, the porous liner adapted adapted for the passage of a portion of the working fluid therethrough.

The present invention further contemplates wherein the porous liner includes at least two layers of a porous sheet.

The present invention further contemplates wherein the porous sheet includes a plurality of apertures each having a diameter, the apertures extending through the porous sheet.

The present invention still further contemplates that in embodiments having more than one layer in the porous liner will have a spacing between adjacent layers, that spacing defining a height of not less than about 3 to about 4 diameters of the apertures.

The present invention further contemplates wherein the diameter of the apertures is more than about 1 mm to less than about 5 mm in size.

The present invention further contemplates wherein the porous liner has a porosity of about 3% to about 10%.

The present invention further contemplates wherein the porous liner is formed from a metal.

In another embodiment of the present invention the porous liner extends from about the trailing edge of a blade of the rotating impeller to about the outlet of the discharge duct.

In another embodiment of the present invention the compressor further includes a diffuser vane in the discharge duct. In a refined of this embodiment the porous liner extends over at least a portion of the diffuser vane.

In another embodiment of the present invention the porous line includes a plurality of openings through which a small amount (relative to the flow of working fluid through the annular diffuser duct) or purge flow working fluid is injected into the diffuser duct.

In another embodiment of the present invention the number of purge openings and the size of the purge openings is selected to provide a predetermined purge flow Mach number. In a refinement of this embodiment, the purge flow Mach number is selected to be in greater than about zero but less than about 0.05.

In another embodiment of the present invention there is a centrifugal gas compressor, comprising a mechanical housing and a rotatable impeller including a plurality of blades located within the mechanical housing. The embodiment further includes a discharge duct in fluid communication with the rotatable impeller, the discharge duct including at least one surface. The embodiment also includes a porous metal liner located within the annular duct and extending along at least a portion of the at least one surface.

In yet another embodiment of the present invention there is a centrifugal gas compressor, comprising a mechanical housing and a rotatable impeller including a plurality of blades located within the mechanical housing. The embodiment further includes a discharge duct in fluid communication with the rotatable impeller, the discharge duct including at least one surface. The embodiment also includes purge flow means for damping pressure pulsations within the discharge duct.

In yet another embodiment of the present invention there is a method for damping pressure pulsations within a centrifugal gas compressor discharge. The method comprising flowing a working fluid from a rotating impeller into an entrance of a discharge duct and through the discharge duct into an outlet of the discharge duct, at least a portion of one wall of the discharge duct between the entrance and the outlet including at least one porous liner. The method further comprising feeding the discharge duct with a purge flow of working fluid through the porous liner.

In yet another embodiment of the present invention there is a method of damping acoustic energy in a centrifugal compressor through which a working fluid flows, comprising passing a purge flow of working fluid through at least one porous liner that is substantially adjacent to at least a portion of one wall of an annular discharge duct of the centrifugal compressor.

Another form of the present invention contemplates a centrifugal gas compressor, comprising: a housing; a rotatable impeller including a plurality of blades located within the housing and adapted for performing work on a working fluid; an annular discharge duct in fluid communication with the rotatable impeller, the annular discharge including at least one surface; and means for damping pressure pulsations within the discharge duct. The present invention further contemplates wherein the means for damping includes a porous liner adapted for the passage of a purge working fluid therethrough.

Yet another form of the present invention contemplates a viscous dissipation method for damping pressure pulsations within a centrifugal gas compressor discharge, comprising: flowing a working fluid from a rotating impeller through an annular duct including at least one porous liner and at least one purge opening; and feeding the porous liner with a purge flow of working fluid, wherein at least a portion of the flow passes through the at least one purge opening.

The present invention further contemplates the method further comprising selecting at least one of a quantity and a size of the at least one purge opening such that the flow maintains a predetermined Mach number. The present invention further contemplates wherein the predetermined Mach number of the flow is selected to be greater than zero but less than about 0.05.

The present invention further contemplates wherein the impeller includes a trailing edge; and wherein the porous liner extends from about the trailing edge. The present invention still further contemplates wherein the annular discharge duct includes an entrance and an exit, wherein the porous liner extends from about the trailing edge to about the exit.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A centrifugal gas compressor, comprising:

a mechanical housing;

a rotatable impeller including a plurality of blades located within the mechanical housing;

a discharge duct in fluid communication with the rotatable impeller, the discharge duct including at least one surface; and a viscous damper having a porous metal liner located within the annular duct and extending along at least a portion of the at least one surface.

2. The compressor of claim 1, wherein the porous metal liner includes at least two layers of a porous metal sheet.

3. The compressor of claim 2, wherein the two layers of the porous metal sheet have about the same porosity.

4. The compressor of claim 1, wherein the metal liner has a porosity of more than 3% but less than 10%.

5. The compressor of claim 1, wherein the porous metal liner is a porous metal sheet having a plurality of holes, each hole having a diameter between about 1 mm to about 5 mm.

6. The compressor of claim 5, wherein the porous liner is spaced apart from a wall of the discharge duct by a distance not less than about 3 times the diameter of the holes.

7. The compressor of claim 1, wherein the impeller has a trailing edge, and wherein the porous metal liner extends from about the trailing edge toward an outlet of the discharge duct.

8. The compressor of claim 7, wherein the discharge duct is an annular discharge duct having an entrance and an outlet, and the trailing edge of the impeller is substantially adjacent to the entrance of the annular discharge duct.

9. The compressor of claim 8, wherein the annular discharge duct includes a plurality of diffuser vanes at the outlet.

10. The compressor of claim 9, wherein the porous liner covers at least a portion of the diffuser vanes.

11. A centrifugal gas compressor, comprising:

a mechanical housing;

a rotatable impeller including a plurality of blades located within the mechanical housing;

a discharge duct in fluid communication with the rotatable impeller, the discharge duct including at least one surface; and purge flow means for damping pressure pulsations within the discharge duct.

12. The compressor of claim 11, wherein the means for damping includes a porous liner having a plurality of holes for the passage of a purge working fluid therethrough.

13. The compressor of claim 12, wherein the porous liner is a metal liner having a porosity in the range of 3% to 10%, and wherein the porous metal liner includes at least one porous metal sheet having a plurality of holes, each hole having a diameter between about 1 mm to about 5 mm.

14. The compressor of claim 13, wherein the porous liner includes two layers of porous metal sheets having porosities that are about equal and wherein the two layers are spaced apart by a distance not less than about 4 times the diameter of the holes.

15. A method for damping pressure pulsations within a centrifugal gas compressor discharge, comprising:

flowing a working fluid from a rotating impeller into an entrance of a discharge duct and through the discharge duct into an outlet of the discharge duct, at least a portion of one wall of the discharge duct between the entrance and the outlet including at least one porous liner; and feeding the discharge duct with a purge flow of working fluid obtained from downstream of the outlet of the discharge duct through the porous liner.

16. The method of claim 15, further comprising:

maintaining the Mach number of the purge flow in the range of greater than zero but less than about 0.05.

17. The method of claim 16, wherein the Mach number is maintained while using a porous liner having a porosity in the range of 3% to 10%, and wherein the porous liner is made of metal and includes at least one porous metal sheet having a plurality of holes, each hole having a diameter between about 1 mm to about 5 mm.

18. A method of damping acoustic energy in a centrifugal compressor through which a working fluid flows, comprising:

selecting the porosity of at least one porous liner based upon acoustic absorption; and passing a purge flow of working fluid through the at least one porous liner that is substantially adjacent to at least a portion of one wall of an annular discharge duct of the centrifugal compressor.

19. The method of claim 18, further comprising:

passing the purge flow into the annular discharge duct through the porous liner having at least a first layer and a second layer, the layers each having a porosity in the range of 3% to 10%.

20. The method of claim 18, further comprising:

maintaining the Mach number of the purge flow of working fluid in the range of greater than zero but less than about 0.05.

* * * * *